US007265648B2

(12) United States Patent
Nishino et al.

(10) Patent No.: US 7,265,648 B2
(45) Date of Patent: Sep. 4, 2007

(54) COMPOSITE CORE NONLINEAR REACTOR AND INDUCTION POWER RECEIVING CIRCUIT

(75) Inventors: Shuzo Nishino, Hyogo (JP); Koji Turu, Kyoto (JP)

(73) Assignee: Daifuku Co., Ltd., Osaka (JP)

( * ) Notice: Subject to any disclaimer, the term of this patent is extended or adjusted under 35 U.S.C. 154(b) by 328 days.

(21) Appl. No.: 10/508,266

(22) PCT Filed: Mar. 14, 2003

(86) PCT No.: PCT/JP03/03095

§ 371 (c)(1),
(2), (4) Date: Jun. 3, 2005

(87) PCT Pub. No.: WO03/079379

PCT Pub. Date: Sep. 25, 2003

(65) Prior Publication Data

US 2005/0253678 A1 Nov. 17, 2005

(30) Foreign Application Priority Data

Mar. 19, 2002 (JP) ..... 2002-076798

(51) Int. Cl.
*H01F 27/36* (2006.01)

(52) U.S. Cl. ..... 336/84 M

(58) Field of Classification Search ..... 336/65, 336/83, 84 R, 84 M, 84 C, 200, 229, 225
See application file for complete search history.

(56) References Cited

U.S. PATENT DOCUMENTS 3,851,287 A * 11/1974 Miller et al. ..... 336/84 R
4,484,171 A * 11/1984 McLoughlin ..... 336/84 R
4,806,896 A * 2/1989 Shikano et al. ..... 336/73
5,402,097 A * 3/1995 Chou ..... 336/192
6,420,952 B1 * 7/2002 Redilla ..... 336/84 M
6,429,762 B1 * 8/2002 Shusterman et al. ..... 336/84 R
6,498,557 B2 * 12/2002 Johnson ..... 336/200

FOREIGN PATENT DOCUMENTS

| | | | |
|---|---|---|---|
| JP | 49-15955 | A | 2/1974 |
| JP | 59-34609 | A | 2/1984 |
| JP | 59-182514 | A | 10/1984 |
| JP | 61-201404 | A | 9/1986 |
| JP | 02-164013 | A | 6/1990 |
| JP | 03-198312 | A | 8/1991 |
| JP | 07-153613 | A | 6/1995 |
| JP | 10-070856 | | 3/1998 |
| JP | 2001-015365 | A | 1/2001 |

* cited by examiner

*Primary Examiner*—Tuyen T. Nguyen
(74) *Attorney, Agent, or Firm*—Barnes & Thornburg LLP

(57) ABSTRACT

A composite core nonlinear reactor comprising a first core member of high permeability material forming a continuous annular magnetic path, a second core member of high permeability material forming an annular magnetic path locally broken by an air gap, a magnetic shield plate of low permeability material exhibiting high conductivity and thermal conductivity being sandwiched by the first and second core member and integrated therewith, and a coil winding, wherein the annular magnetic paths of the first and second core members are juxtaposed while sandwiching the magnetic shield plate and the coil winding is wound to interlink with both annular magnetic paths commonly

20 Claims, 2 Drawing Sheets

COMPOSITE CORE NONLINEAR REACTOR AND INDUCTION POWER RECEIVING CIRCUIT

CROSS-REFERENCE TO RELATED APPLICATIONS

This application is a U.S. national counterpart application of international application serial no. PCT/JP03/03095 filed Mar. 14, 2003, which claims priority to Japanese application serial no. 2002-076798 filed Mar. 19, 2002.

TECHNICAL FIELD

The present invention relates to a composite core nonlinear reactor used for the purpose of adjustment and control of an AC power supply system, and to an induction incoming circuit using the reactor.

BACKGROUND ART

In Japanese Patent Application Laid-open (kokai) Pub. No. H10-70856, an invention is disclosed which relates to a constant-voltage induction feeding apparatus using a saturable reactor. This is an apparatus for supplying driving electric power to a vehicle running along a track, from the track to the vehicle in a non-contact manner using electromagnetic induction. The induction incoming circuit mounted on the vehicle comprises, as its basic structure, a receiving coil for generating an induced electromotive force when it is placed in an alternating field (at a constant frequency of approximately 10 kHz) generated by an equipment associated with the track, a resonance capacitor connected with the receiving coil and forming a resonance circuit tuned at the frequency of the magnetic field, and a converter for rectifying AC power extracted from the resonance circuit and providing it to a load such as a motor.

In the case of this induction incoming circuit, when the load consumes little power (referred to as "light-load state"), the circuit is broken because the induced voltage of the receiving coil is increased without any limitation as far as any restrictive factor does not work. Therefore, the above prior art employs a structure in which any abnormal increase of the voltage is regulated, i.e., the voltage is maintained constant, by connecting in parallel a saturable reactor with the resonance circuit formed by the receiving coil and the capacitor.

The inventors have continued studying further the various characteristics that a nonlinear reactor suitable for the above purpose should have. In case of a saturable reactor to be used in a high-frequency region of 10 KHz or higher, there is an advantage that the eddy-current loss heating caused by the high-frequency magnetic field is small when the core is formed of ferrite presenting a characteristic of high resistance. However, since ferrite considerably changes its magnetic characteristic (a saturation magnetic flux density) according to its temperature, there is a problem that the above-described constant voltage characteristic provided by the saturable reactor is not stable when the temperature fluctuation of the environment where the reactor is used is large.

Since an amorphous alloy soft magnetic material and a nanocrystal soft magnetic material show a stable magnetic characteristic against temperature fluctuation, there is an advantage that the constant voltage characteristic is stable even if the temperature fluctuation of the environment where the reactor is used is large when a saturable reactor having a core formed of such a material is used. However, when the core is formed of this kind of material by winding the material shaped in a strip, there is a problem that an eddy-current tends to be generated on the surface of the strip when a steep pulse current flows in the coil and, thereby, the core itself is heated remarkably.

For either core material, in the structure in which the saturable reactor is connected with the above-described induction incoming circuit for maintaining the voltage constant, the core becomes magnetically saturated in the vicinity of the peak of each half wave of a high frequency of 10 KHz or higher in an operation mode effecting an action of maintaining the voltage constant and, therefore, a steep pulse current flows in the coil wound around the core (thereby, any voltage increase is regulated). As known, this kind of steep high-frequency pulse current has a serious problem that it gives hazardous electromagnetic interference (EMI) to the surroundings.

The present invention was conceived in light of the above technical considerations. The object of the invention is to provide a composite core nonlinear reactor capable of stably suppressing any voltage increase without generating any steep pulse current and of alleviating its heating and its EMI problem, and to provide an induction incoming circuit using such a reactor.

DISCLOSURE OF THE INVENTION

An aspect of the present invention provides a composite core nonlinear reactor comprising a first core member made of a high-magnetic-permeability material and forming a continuous annular magnetic path; a second core member made of a high-magnetic-permeability material and forming an annular magnetic path locally broken by an interstice; a magnetic shielding plate made of a low-magnetic-permeability material having high electric conductivity and high heat conductivity, integrally sandwiched between the first core member and the second core member; and a coil, wherein the annular magnetic path of the first core member and the annular magnetic path of the second core member are juxtaposed sandwiching the magnetic shielding plate, the coil being wound such that the coil commonly crosses consecutively both of the annular magnetic paths.

Another aspect of the present invention provides a composite core nonlinear reactor comprising two first core members made of a high-magnetic-permeability material and each forming a continuous annular magnetic path; a second core member made of a high-magnetic-permeability material and forming an annular magnetic path locally broken by an interstice; two magnetic shielding plates made of a low-magnetic-permeability material having high electric conductivity and high heat conductivity, each positioned on each side of the second core member respectively, each of the two magnetic shielding plates being integrally sandwiched between the first core members and the second core member, respectively; and a coil, wherein the annular magnetic path of the two first core members and the annular magnetic path of the second core member are juxtaposed in a triple-in-line formation sandwiching the two magnetic shielding plates, the coil being wound such that the coil commonly crosses consecutively the triple-in-line annular magnetic paths.

Still another aspect of the present invention provides an induction incoming circuit for supplying electric power from a resonance circuit to a load, comprising a receiving coil placed in an alternating field at a predetermined frequency and for generating an induced electromotive force; and a resonance capacitor connected with the receiving coil and forming a resonance circuit tuned to the frequency of the magnetic field, wherein the coil of the composite core nonlinear reactors according to one of the above aspects is connected in parallel to the resonance capacitor.

BEST MODE FOR CARRYING OUT THE INVENTION

Figure 1:
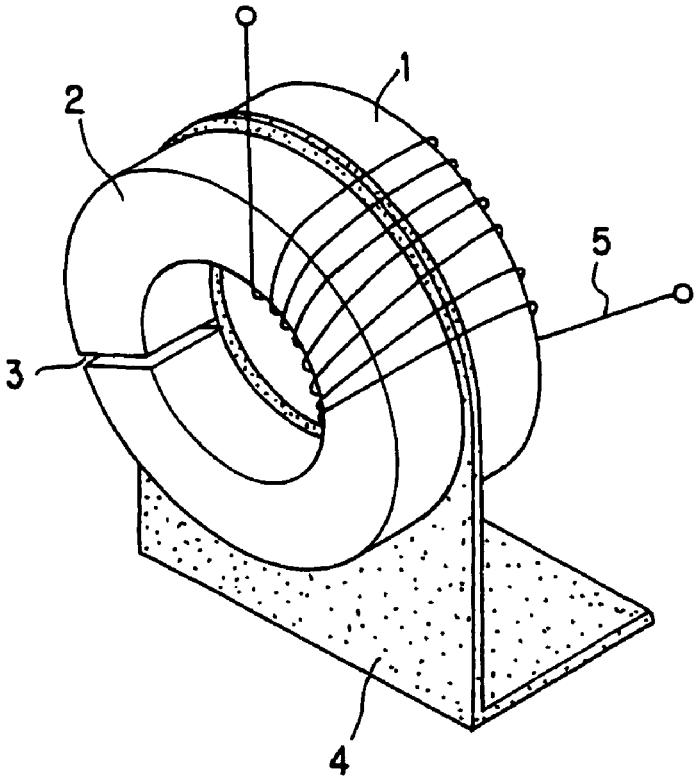
FIG. 1 is a perspective view of a composite core nonlinear reactor according to a first embodiment of the invention.

A basic embodiment of a composite core nonlinear reactor according to the invention is shown in FIG. 1. In this embodiment, both of a first core member 1 having no interstice and a second core member 2 having an interstice 3 are annular cores formed by winding densely in a roll a strip-shaped material of amorphous alloy soft magnetic material or a nanocrystal soft magnetic material. As to the second core member 2, a portion of its annular ring is cut out to provide the interstice 3 as shown in the figure.

As the material of a magnetic shielding plate 4, aluminum, copper or SUS304 is suitable. The magnetic shielding plate 4 of the embodiment shown in FIG. 1 is formed being folded in an L-shape to be used also as a bracket, and its main face is larger than the outer diameter of the core members 1 and 2 and a hole having an inner diameter almost same as that of the core members 1 and 2 is bored through it. The first core member 1 and the second core member 2 are joined respectively on each side of the magnetic shielding plate 4 such that both of the core members 1 and 2 align with the hole, and annular magnetic paths in the first core member 1 and the second core member 2 are juxtaposed sandwiching the magnetic shielding plate 4. A coil 5 is wound around the core members 1 and 2 through the hole of the magnetic shielding plate 4 such that the coil 5 commonly crosses consecutively these two annular magnetic paths.

For each of the core members 1 and 2 formed of the strip-shaped material wound densely, annular flat portions on both sides of it are the faces where side edges of the strip-shaped material are integrated and these surfaces have excellent heat conductivity. These surfaces are joined to the magnetic shielding plate 4. However, when joining them, they must be joined such that the heat coupling is dense so as to conduct the heat generated from the core members 1 and 2 to the magnetic shielding plate 4 as efficiently as possible. For this joining, an insulating sheet made of silicone etc. is intervened between them or an insulating paint such as epoxy is applied between them such that the joining is electrically insulated. By virtue of this electric insulation, the magnetic shielding plate 4 can be prevented from becoming a route for the eddy-current to flow.

The magnetic shielding plate 4 of the embodiment has a shape capable of being used as a fixing bracket of this composite core nonlinear reactor itself and this bracket function of the magnetic shielding plate 4 is effective for bringing the surrounding structures (mainly those made of iron) away from the influence of the magnetomotive force generated by the coil 5 and the bracket portion also contributes effectively to heat dissipation.

Figure 4:
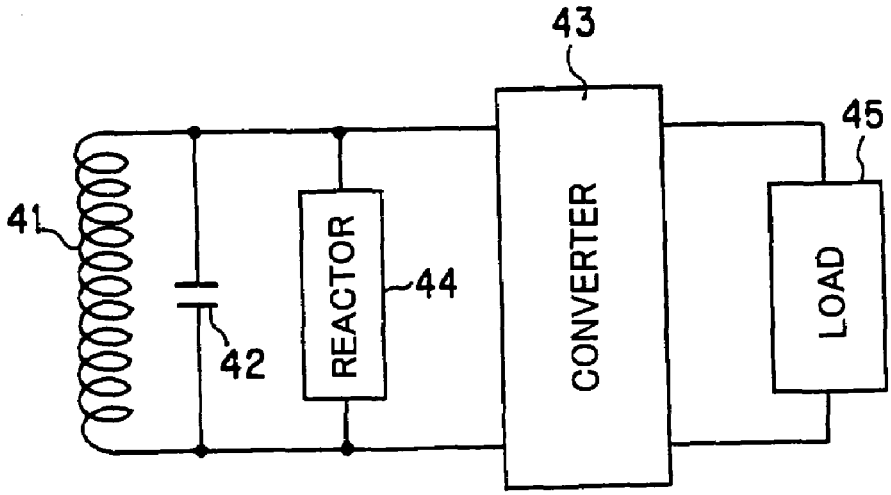
FIG. 4 is a circuit diagram of an induction incoming circuit in which is incorporated the composite core nonlinear reactor of the invention.

The composite core nonlinear reactor shown in FIG. 1 structured as above is integrated in, for example, an induction incoming circuit shown in FIG. 4. The circuit shown in FIG. 4 comprises a receiving coil 41 placed in an alternating magnetic field at a constant frequency of approximately 10 kHz and for generating an induced electromotive force, a resonance capacitor 42 connected with the receiving coil 41 and forming a resonance circuit tuned at the magnetic field frequency and a converter 43 for rectifying AC power extracted from the resonance circuit and providing it to a load 45 such as a motor. A composite core nonlinear reactor 44, more specifically the coil 5 thereof, according to the invention is connected in parallel to a resonance capacitor 42.

Keeping in mind the application shown in FIG. 4, the action of the composite core nonlinear reactor of the invention will be described.

The first core member 1 having no interstice naturally has considerably less magnetic resistance than the second core member 2 having the interstice 3. Therefore, the magnetization force of the current flowing in the coil 5 generates a magnetic flux exclusively in the first core member 1 in an area which is not magnetically saturated in the first core member 1. Under this situation, the reactor 44 shows a high inductance value. Once the magnetic flux density of the first core member 1 has saturated, then, the magnetization force generated by the coil current starts to generate a magnetic flux in the second core member 2. When the first core member 1 saturates magnetically, the inductance originating from this becomes almost zero. However, since a magnetic flux is generated in the second core member 2 at the same time, the inductance of the reactor 44 itself maintains a certain value. Therefore, a pulse current flowing in the reactor 44 is not so steep and so excessive even if the first core member 1 saturates magnetically. That is, an action of voltage suppression works mildly and the problems of the heating and the electromagnetic interference caused by the eddy-current originating from the steep and excessive pulse current can be alleviated. Furthermore, though a magnetic flux leaks out to the surrounding environment from the interstice 3 of the second core member 2, this flux can be prevented by the magnetic shielding plate 4 from entering the first core member 1 to generate eddy-current loss.

As being obvious from the description presented above, the composite core nonlinear reactor has an effect of voltage suppression, i.e., a surge killer. Furthermore, since the surge energy flows in the coil 5 as a current and is converted to magnetic energy and, at the same time, is consumed as resistive loss of the coil 5 and lead wires connected with the coil 5 when a voltage that saturates the first core member 1 or a higher voltage is applied, the reactor has a characteristic of high surge resistance and is effective for absorbing repetitive surges.

Figure 2:
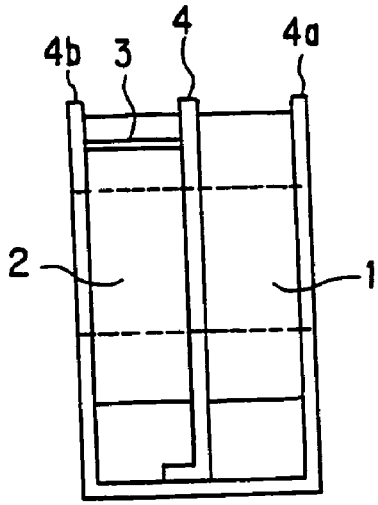
FIG. 2 is a front view of a composite core nonlinear reactor according to a second embodiment of the invention, excluding a coil.

Furthermore, the magnetic shielding plate 4 plays a role of quickly dissipating the heat generated in the core members 1 and 2 and preventing them from overheating. The portion extruding and spreading out of the core members 1 and 2 (radiation fin portion) can be made larger by making the magnetic shielding plate 4 larger to strengthen the role of this dissipation. As illustrated by the embodiment shown in FIG. 2 (the coil is not shown), it is effective on both of the magnetic field insulation and the heat dissipation to join magnetic shielding plates 4*a* and 4*b* integrally to the outer faces of the core members 1 and 2 respectively.

Figure 3:
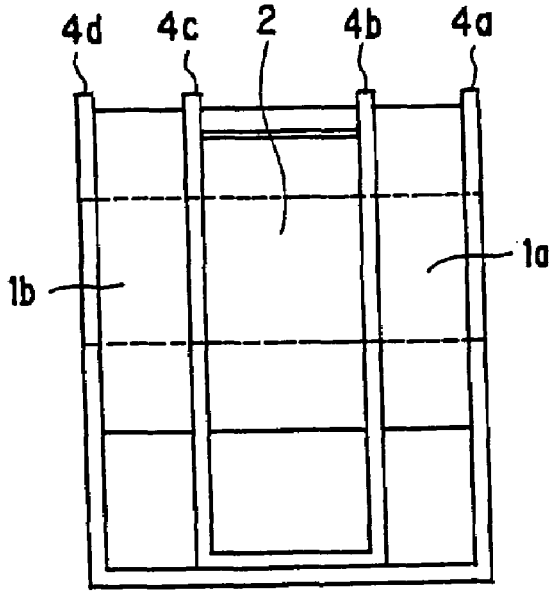
FIG. 3 is a front view of a composite core nonlinear reactor according to a third embodiment of the invention, excluding a coil.

The main parameters dominating the characteristics of the composite core nonlinear reactor of the invention are the cross-sectional area of the first core member 1, the cross-sectional area of the second core member 2, the size of the interstice 3, the number of turns of the coil 5, etc. and a reactor having desired nonlinear characteristics can be realized by setting these parameters properly. Therefore, a variation of the structure to do so is illustrated as an embodiment shown in FIG. 3 in which the coil is omitted. In this embodiment, two first core members 1*a* and 1*b* having a smaller cross-sectional area are juxtaposed in a triple-in-line formation respectively on both sides of the second core member 2 having a larger cross-sectional area. 4A to 4*d* are magnetic shielding plates same as the one described above.

INDUSTRIAL APPLICABILITY

According to the embodiments of the invention described above, in applications such incorporating a plurality of composite core nonlinear reactors in an induction incoming circuit for voltage suppression, the problem of electromagnetic interference originating from the steep and excessive pulse current is alleviated since the action of voltage suppression works at a stable voltage level with a large surge resistance and, furthermore, mildly. Moreover, since the reactor is difficult to be heated, design for mounting it to an apparatus becomes easier, thus contributing to downsizing of apparatuses.

What is claimed is:

1. A composite core nonlinear reactor comprising:

a first core member made of a high-magnetic-permeability material and forming a continuous annular magnetic path;

a second core member made of a high-magnetic-permeability material and forming an annular magnetic path locally broken by an interstice;

a magnetic shielding plate made of a low-magnetic-permeability material having high electric conductivity and high heat conductivity, integrally sandwiched between the first core member and the second core member; and a coil, wherein the annular magnetic path of the first core member and the annular magnetic path of the second core member are juxtaposed sandwiching the magnetic shielding plate, the coil being wound such that the coil commonly crosses consecutively both of the annular magnetic paths.

2. A composite core nonlinear reactor according to claim 1, wherein the magnetic shielding plate is joined integrally to the outer surfaces of both the first core member and the second core member.

3. A composite core nonlinear reactor comprising:

two first core members made of a high-magnetic-permeability material and each forming a continuous annular magnetic path;

a second core member made of a high-magnetic-permeability material and forming an annular magnetic path locally broken by an interstice;

two magnetic shielding plates made of a low-magnetic-permeability material having high electric conductivity and high heat conductivity, positioned on each side of the second core member respectively, each of the two magnetic shielding plates being integrally sandwiched between the first core members and the second core member, respectively; and a coil, wherein the annular magnetic path of each of the two first core members and the annular magnetic path of the second core member are juxtaposed in a triple-in-line formation sadwiching the two magnetic shielding plates, the coil being wound such that the coil commonly crosses consecutively the triple-in-line annular magnetic paths.

4. A composite core nonlinear reactor according to claim 3, wherein the magnetic shielding plate is joined integrally to each of the outer surfaces of the two first core members.

5. A composite core nonliner reactor according to claim 1, wherein the magnetic shielding plate is provided integrally with a heat dissipation fin portion having a geometry that extrudes and spreads out of geometries of the first core member and the second core member.

6. A composite core nonlinear reactor according to claim 1, wherein the magnetic shielding plate and the core members are joined together in an electrically insulated manner.

7. An induction incoming circuit for supplying electric power from a resonance circit to a load, comprising:

a receiving coil placed in an alternating field at a predetermined frequency and for generating an induced electromotive force; and a resonance capacitor connected with the receiving coil and forming a resonance circuit tuned to the frequency of the magnetic field, wherein the coil of the composite core nonlinear reactor according to claim 1 is connected in parallel to the resonance capacitor.

8. A composite core nonlinear reactor according to claim 2, wherein the magnetic shielding plate is provided integrally with a heat dissipation fin portion having a geometry that extrudes and spreads out of geometries of the first core member and the second core member.

9. A composite core nonlinear reactor according to claim 3, wherein the magnetic shielding plate is provided integrally with a heat dissipation fin portion having a geometry that extrudes and spreads out of geometries of the first core member and the second core member.

10. A composite core nonlinear reactor according to claim 4, wherein the magnetic shielding plate is provided integrally with a heat dissipation fin portion having a geometry that extrudes and spreads out of geometries of the first core member and the second core member.

11. A composite core nonlinear reactor according to claim 2, wherein the magnetic shielding plate and the core members are joined together in an electrically insulated manner.

12. A composite core nonlinear reactor according to claim 3, wherein the magnetic shielding plate and the core members are joined together in an electrically insulated manner.

13. A composite core nonlinear reactor according to claim 4, wherein the magnetic shielding plate and the core members are joined together in an electrically insulated manner.

14. A composite core nonlinear reactor according to claim 5, wherein the magnetic shielding plate and the core members are joined together in an electrically insulated manner.

15. A composite core nonlinear reactor according to claim 8, wherein the magnetic shielding plate and the core members are joined together in an electrically insulated manner.

16. A composite core nonlinear reactor according to claim 9, wherein the magnetic shielding plate and the core members are joined together in an electrically insulated manner.

17. A composite core nonlinear reactor according to claim 10, wherein the magnetic shielding plate and the core members are joined together in an electrically insulated manner.

18. An induction incoming circuit for supplying electric power from a resonance circuit to a load, comprising:

a receiving coil placed in an alternating field at a predetermined frequency and for generating an induced electromotive force; and a resonance capacitor connected with the receiving coil and forming a resonance circuit tuned to the frequency of the magnetic field, wherein the coil of the composite core nonlinear reactor according to claim 2 is connected in parallel to the resonance capacitor.

19. An induction incoming circuit for supplying electric power from a resonance circuit to a load, comprising:

a receiving coil placed in an alternating field at a predetermined frequency and for generating an induced electromotive force; and a resonance capacitor connected with the receiving coil and forming a resonance circuit tuned to the frequency of the magnetic field, wherein the coil of the composite core nonlinear reactor according to claim 3 is connected in parallel to the resonance capacitor.

20. An induction incoming circuit for supplying electric power from a resonance circuit to a load, comprising:

a receiving coil placed in an alternating field at a predetermined frequency and for generating an induced electromotive force; and a resonance capacitor connected with the receiving coil and forming a resonance circuit tuned to the frequency of the magnetic field, wherein the coil of the composite core nonlinear reactor according to claim 4 is connected in parallel to the resonance capacitor.

* * * * *